United States Patent [19]

Arant

[11] 3,987,130

[45] Oct. 19, 1976

[54] STEAM AND WATER BLENDING SYSTEM FOR STEAM VAULTS

[75] Inventor: Perry Arant, Newport Beach, Calif.

[73] Assignee: Clayton Manufacturing Company, El Monte, Calif.

[22] Filed: Mar. 20, 1968

[21] Appl. No.: 714,744

[52] U.S. Cl. ..... 261/34 R; 261/58; 261/DIG. 32; 137/495

[51] Int. Cl.[2] ..... B01F 3/04

[58] Field of Search ..... 261/34, 26, 58, DIG. 32; 137/90, 565, 495; 73/211; 259/4; 99/251; 34/48; 122/487, 459, 31 X; 60/39.53, 39.59

[56] References Cited

UNITED STATES PATENTS 2,837,241 6/1958 Griswold ..... 138/44 X

*Primary Examiner*—Bernard Nozick

*Attorney, Agent, or Firm*—Harry W. F. Glemser

[57] ABSTRACT

Apparatus for blending dry or slightly moist steam with water to produce wet steam of 20% to 70% moisture content by weight for treating logs or other objects in a closed steam treatment vat or vault. The apparatus includes a blender having a mixing chamber, to one end of which comparatively dry steam from a suitable source is supplied at constant pressure and flow rate through a pilot-operated pressure reducing main valve and a metering orifice. The blender also has a port through which water at a constant pressure and volume is supplied to the mixing chamber by a positive displacement pump maintained under a constant gravity head of water in an elevated supply tank. The outlet of the blender is connected to a back pressure regulator for controlling the outlet pressure of the blended mixture of water and steam to be supplied to the vault. The pilot valve is connected across the main steam valve and has a solenoid valve connected in the line supplying operating fluid to said main valve. The apparatus is controlled by a circuit including switches connected to the solenoid valve, and to an electric motor for driving the positive displacement water pump. The switches are connected in circuit with a sensing switch that is responsive to the temperature of the condensate within the vault, or to some other suitable criteria. The system functions automatically to blend water with relatively dry steam to continuously or intermittently supply wet steam having a substantially constant high moisture content at a substantially constant volume and pressure, as conditions in the vault require.

11 Claims, 6 Drawing Figures

INVENTOR.
PERRY ARANT
BY
Bacon & Thomas
ATTORNEYS

INVENTOR.
PERRY ARANT
BY Bacon & Thomas
ATTORNEYS

INVENTOR.
PERRY ARANT

BY

Bacon & Thomas
ATTORNEYS

INVENTOR.
PERRY ARANT
BY
Bacon & Thomas
ATTORNEYS

STEAM AND WATER BLENDING SYSTEM FOR STEAM VAULTS

BACKGROUND OF THE INVENTION

1. Field of the Invention

The invention relates generally to apparatus for supplying highly saturated or wet steam to a treatment chamber, such as is contained in a closed vault. More particularly, the invention relates to novel but relatively simple apparatus for use with conventional steam boilers in industrial plants and the like, which produce dry or low moisture content steam, to enable such steam to be converted into highly saturated steam. The present apparatus automatically blends water with the steam from such boiler in controlled proportions, to produce highly saturated steam having a substantially constant moisture content, and a substantially constant pressure. Thus, existing plant facilities can be adapted to provide a form of steam for processing materials that could not be satisfactorily or efficiently processed with the previously available steam.

2. Description of the Prior Art

The satisfactory treating of some materials or objects in a steam treatment vault frequently requires the use of wet steam having a moisture content of say from 20% to 70% by weight. The steam boilers commonly available in a factory or mill are usually designed to produce dry steam, i.e., steam with little or no moisture content. Hence, these available steam supply sources cannot be used directly to supply wet steam to a treatment vault requiring such steam.

There is obtainable, commercially, specially designed steam generator units capable of supplying wet steam of a desired moisture content at a desired pressure, and such are presently used to supply treatment vaults where wet steam is necessary. However, where a new need arises for wet steam, due to changes in processes or installation of new equipment, and there is already available a supply of dry steam, it is more economical to utilize the existing facilities instead of acquiring a special new steam generator. Prior efforts have been made to provide adjunct devices to be used with such available facilities, but these have not proved reliable, or respond slowly, or require constant manual adjustment and attention, rendering them impractical. The present invention is directed to adjunct apparatus that can be installed for this purpose, and will operate automatically and satisfactorily.

The treatment process performed in a steam vault frequently requires wet steam of a specific, substantially constant, high moisture content, supplied at a constant rate and pressure, and preferably without off-quality or time lag, whenever there is a demand. The commercially available steam generator units specially designed for this purpose can meet these requirements, but prior to this invention there has been no known auxiliary apparatus capable of automatically converting available dry steam and water into a supply of wet steam of a given constant high moisture content, at a given constant pressure and volume, on instant demand.

One example of a process requiring wet steam involves the treatment of logs to prepare them for peeling in a lathe designed to cut sheets for use as veneer or for plywood. It has been found, according to a new process forming no part of the present invention, that by treating logs of a given specie of wood with wet steam having a moisture content of from 20% to 70% by weight, and preferably about 55% by weight, and under a pressure of 40 to 100 psig, and preferably about 60 psig, for a prescribed period of time, the wood fibers can be made relatively uniform in texture by heating and moisture saturation so that alternating bands of soft and hard growth, knots and the like will not interfere with the peeling of uniform sheets from the log by the lathe. The steam supply is automatically controlled in accordance with variations in the condensate temperature draining from the vault. The vault utilized to treat such logs is usually quite large, with typical dimensions being approximately 75 feet long, 14 feet high, and 12 feet wide, the vault being stacked substantially full of short 8 ½ foot long logs for each treatment cycle. A typical plywood mill will have several such vaults, and thus, with the improved process, there is a demand for great quantities of wet steam.

The typical plywood mill operating under prior methods of steam treating logs has available dry steam and water in abundant supply, and hence it would be most economical if the available supply could be utilized to vaporize the treatment vaults to treat the logs in accordance with the improved, highly saturated steam process. In order to accomplish this, apparatus is provided in accordance with the present invention to blend water with the available dry steam in such a way as to produce wet steam of the desired constant, high moisture content, at the desired constant, volume and pressure, immediately upon demand.

SUMMARY OF THE INVENTION

The blending apparatus of the invention is designed as a unit, and is connected to an available supply of dry steam and an available water line. The outlet of the unit is connected to a treatment vault, and the unit functions automatically when activated to blend water with dry steam to produce wet steam of a desired substantially constant, high moisture content, at a relatively constant pressure and volume. The unit includes a control system, which is operated by a thermally responsive sensing switch or monitoring unit located in the path of condensate flow in the condensate trough of the treatment vault, the control system being connected to activate the blending unit whenever there is a demand for wet steam, and to deactivate the unit when the demand ceases.

The present apparatus includes a blender containing a cylindrical blending chamber to the inlet end of which dry steam is admitted at a controlled rate through an orifice plate. Dry steam is supplied to the orifice plate through a pilot valve operated pressure reducing main valve, the inlet of which is connected to an available steam line. A pressure operating-fluid conduit connects the inlet side of the main valve with its pilot valve control. A solenoid-operated control valve is connected in the conduit so that when the solenoid control valve is open the main valve is automatically opened and functions to admit steam at a constant, selected pressure and rate to a blending chamber in the blender, and when the solenoid valve is closed the main valve is also closed.

Water is admitted into the blending chamber through an inlet port in the sidewall thereof near the outlet end of the chamber, and is mixed with the dry steam within the chamber to produce wet steam. The water is supplied to the water inlet port from a constant head supply tank, by a positive displacement pump driven by an electric motor. The pump is operated only when the motor is energized, and in cooperation with the constant head supply tank, furnishes water to the blender at a uniform, carefully metered flow rate.

The outlet of the blender is connected through a back-pressure regulator to the inlet of the vault, the back-pressure regulator functioning to maintain a constant pressure within the blending chamber, and hence a constant pressure differential across the orifice plate. By thus controlling the steam pressure and steam flow rate, the flow rate of the water, and the pressure within the blending chamber, wet steam of substantially constant moisture content, pressure and volume can be immediately supplied to the vault.

The control system includes an electrical circuit containing switches connected to the solenoid valve and to the pump motor. The circuit also includes a master "ON-OFF" switch and a thermally responsive sensing switch connected in series. The thermally responsive switch is positioned at the discharge end of the condensate trough of the vault, and is adjusted to open only when the temperature of the condensate rises to a preset value. With the master switch in the "ON" position and with a temperature in the vault lower than desired, the condensate temperature would be low and the solenoid valve will open the pilot valve will be supplied with pressure to open and correspondingly allow opening of the main steam valve. The pump motor will be simultaneously emergized and deliver water for blending with the steam. When the vault condensate temperature rises sufficiently to open the thermally responsive sensing switch, the solenoid valve will close and the pump motor will be deenergized. The blending unit will then stop operating until the vault condensate temperature falls sufficiently to again close the thermally responsive sensing switch. Thus, steam of the desired moisture content is automatically supplied to the treatment vault whenever conditions in the vault require as reflected by changes in the vault condensate temperature.

It is an object of the present invention to provide a steam and water blending system that can be connected with any suitable supply of dry steam and water, and which functions automatically to produce wet steam having a substantially constant rate of flow, moisture content and pressure.

Another object is to provide a blender designed to effectively blend water with dry steam, to produce a highly moisture-laden vapor.

A further object is to provide a steam and water blender combined with a control system that functions to automatically activate and deactivate the blender, in response to the demand for wet steam.

Other objects and many of the attendant advantages of the present invention will become readily apparent from the drawings, when taken in conjunction with the following description of the preferred embodiment of the invention.

DESCRIPTION OF THE DRAWINGS

FIG. 4 is an enlarged transverse vertical sectional view through the mixing chamber of the steam and water blender taken on the line 4—4 of FIG. 2;

FIG. 5 is a staggered longitudinal sectional view, taken on the line 5—5 of FIG. 4, showing the internal construction of the blender.

DESCRIPTION OF THE PREFERRED EMBODIMENT

Figure 1:
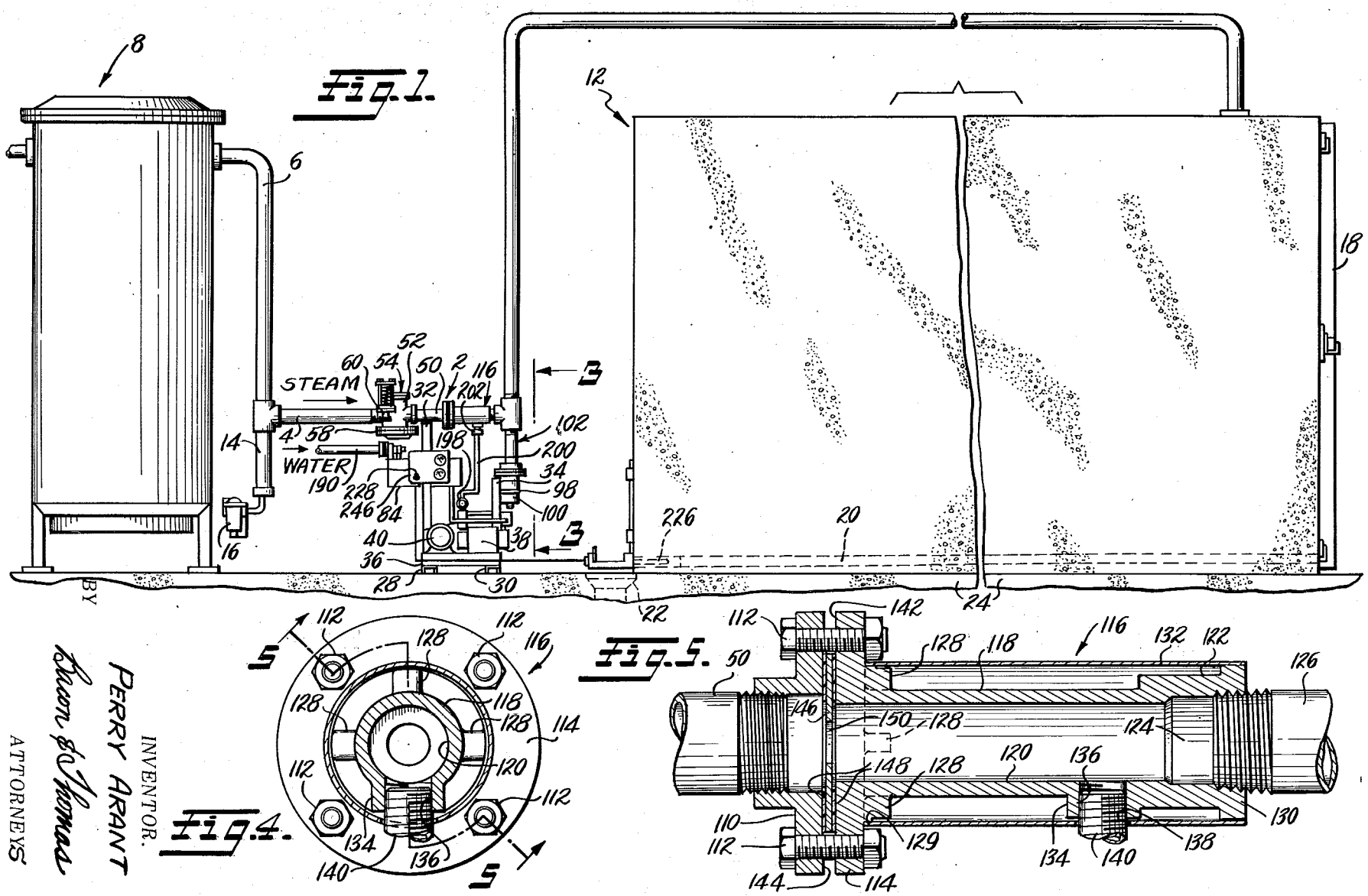
FIG. 1 is an elevational view showing the present blending system in a typical operational environment for supplying wet steam to a treatment vault.

Referring now to the drawings, the blending device or assembly 2 of the present invention is connected by an inlet conduit 4 to a steam line 6 leading from a conventional steam boiler 8, and by an outlet conduit 10 to a concrete steam treatment vault 12 containing spray nozzles, not shown. The steam line 6 has a conventional drip leg 14 and steam trap 16, and can be a part of the main steam distribution system of a factory or mill.

The treatment vault 12 is designed, for example, to treat logs preparatory to peeling in a veneer lathe. The vault 12 typically would measure about 75 feet long, 14 feet high, and 12 feet wide, and is fitted with a door 18 at one end thereof for loading and unloading logs. The vault 12 has a longitudinal, central condensate trough 20 in the floor thereof, which empties into a drain 22 in the floor 24. Obviously, the present apparatus is in no way limited to the type of vault shown at 12, but can be used to supply wet steam to any treatment vat or vault.

Figure 3:
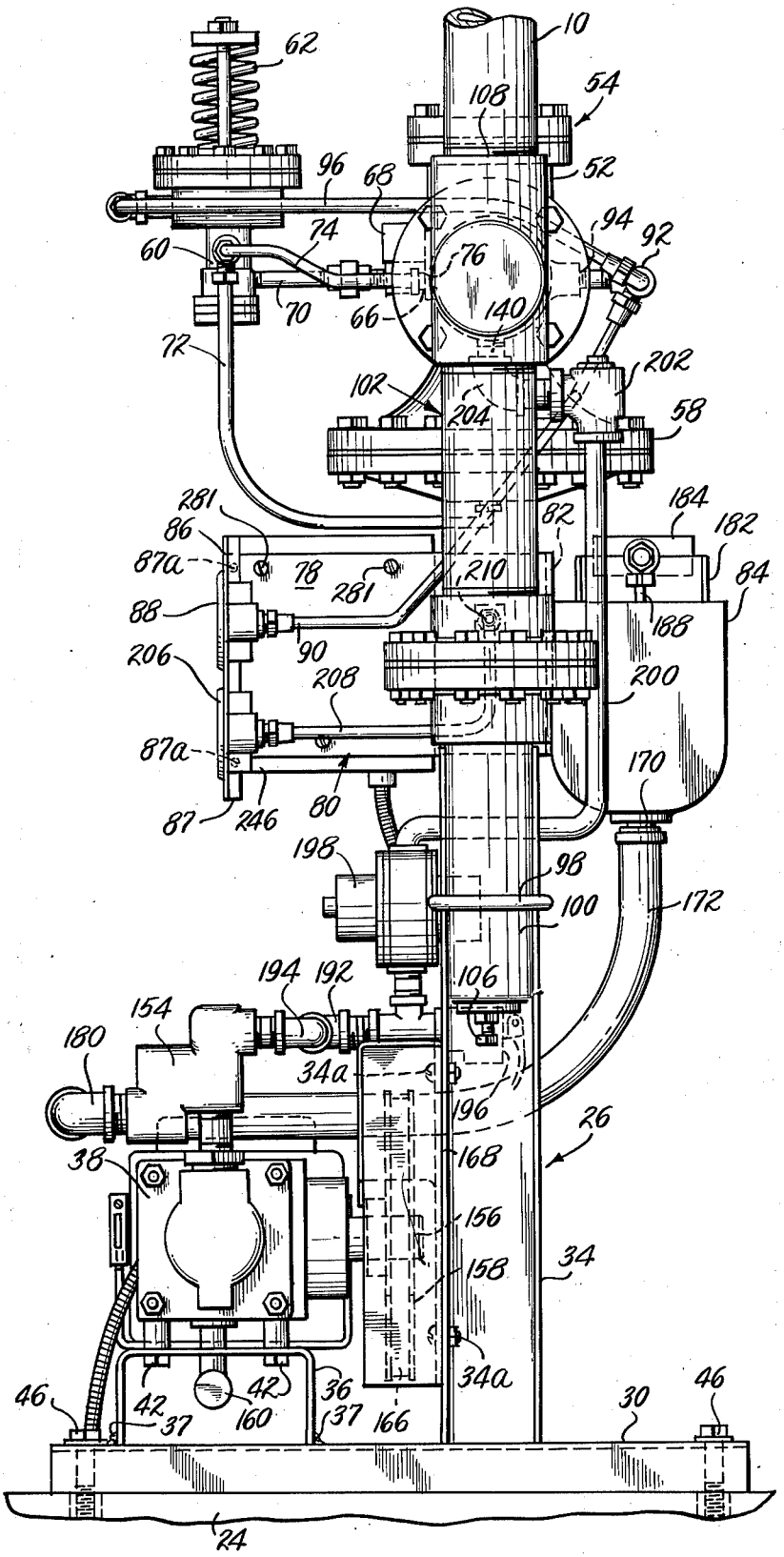
FIG. 3 is an enlarged right end elevational view of the assembly, as viewed on the line 3—3 of FIG. 1.

The blending device 2 includes a frame 26, comprising a pair of parallel channel-shaped base members 28 and 30 to which the lower end of upright channel members 32 and 34, respectfully, are welded. A larger channel 36, FIG. 3, is welded at 37 to the base members 28 and 30 in front of the upright members 32 and 34, and serves as a mounting bracket for a positive displacement pump 38 and its electric driving motor 40. The pump 38 and the motor 40 are secured to the bracket 36 by bolts 42 and 44, respectively. The base members 28 and 30 of the frame 26 are secured to the floor 24 by anchor bolts 46, to fix the blending device 2 in position.

The left channel upright 32 is taller than the right upright 34, and has a horizontal mounting plate 48 welded to the upper end thereof. A pipe section 50, connected at one end to the outlet of the body 52 of a conventional pilot-operated pressure reducing main valve 54, is clamped to the mounting plate 48 by a U-bolt 56 to thus mount the main valve 54 on the frame 26. The conduit 4 leading from the steam line 6 is connected to the inlet of the main valve 54 which includes a pressure-responsive disphragm type operating unit 58 extending downwardly from the valve body 52.

The main valve 54 is controlled by a conventional pilot valve 60, which includes an adjustable spring 62 for setting the pressure limits at which the main valve 54 will respond, i.e., open and close. The body 52 of the main valve 54 has a threaded port 64 communicating with the inlet of said body and to which one end of a short nipple 66 is connected. The other end of the nipple 66 is connected to the inlet of a conventional solenoid-operated valve 68, the outlet of which is connected by a nipple 70 to the inlet of the pilot valve 60. The nipples 66 and 70 mount both the pilot valve 60 and the solenoid valve 68 on the main valve 54.

The outlet of the pilot valve 60 is connected by a conduit 72 to the pressure chamber of the diaphragm-operating unit 58 to supply operating fluid thereto for operating the main valve 54. A conduit 74 leads from the conduit 72 to a bleed orifice 76 in the outlet side of the body 52 of the main valve 54 for by-passing operating fluid at a controlled rate to allow the main valve to modulate, and to exhaust operating fluid from the diaphragm unit 58 and permit the main valve to close when the solenoid valve 68 closes to cut off the supply of operating fluid. The pilot valve 60 is operational, when the solenoid valve 68 is open and controls flow of steam pressure from the line 70, to line 72 to control the main valve 54 to reduce the pressure of the steam flowing through the main valve 54 according to the setting of the spring 62. The main valve 54 is normally closed, and is opened only in response to pressure supplied to the diaphragm unit 58. When the solenoid valve 68 is closed, steam from the inlet of the main valve body 52 cannot reach the pilot valve 60, and hence the diaphragm unit 58 will not be supplied with pressure and the main valve 54 will remain closed.

Secured to the right side of the upright channel 32, FIG. 2, below the main valve 54, in one leg 78 of an L-shaped bracket 80, the other leg 82 extending laterally behind the upright 32 in the direction of the main valve 54. The leg 82 supports an elongated, rounded bottom, water supply tank 84, welded thereto at 85. Secured to the forward end of the bracket leg 78 is a plate 86, FIG. 3, having a flange 87 carrying bolts 87*a*. A gauge 88 is mounted on the plate 86 and is connected by a tube 90 to an end of a T-fitting 92, the center leg of which is connected to a pressure port 94 on the outlet side of the main valve body 52. The other end of the fitting 92 is connected by a tube 96 to a pressure chamber in the pilot valve 60 to oppose the force of spring 62 to modulate the action of the pilot valve 60 in accordance with the steam pressure at the outlet side of the main valve 54.

Secured to the upright channel 34 by a U-bolt 98 is the lower body portion 100 of a conventional back pressure regulator assembly 102, the regulator 102 being mounted so that the inlet 104 thereof is aligned with the pipe section 50 connected to the outlet of the main valve 54. The regulator 102 includes an adjusting screw 106, for setting the pressure level that the regulator will maintain in the blending device 2. The outlet 108 of the regulator 102 is connected to the conduit 10 leading to the vault 12.

The outlet end of the pipe 50 has a flange 110 threaded thereon, FIG. 5, and connected to said flange by bolts 112 is the flanged end 114 of the blender 116. The blender 116 includes an elongated body 118 having a uniform-diameter cylindrical blending chamber 120 therein, the flange 114 being integral with the inlet end of said body 118. The other end 122 of the body 118 has an enlarged threaded bore portion 124 at the outlet end of the blending chamber 120 to receive a pipe 126 that connects the blender 116 with the inlet 104 of the back pressure regulator 102.

The blender body 118 has four circumferentially arranged bosses 128 formed thereon adjacent the flange 114, terminating in a raised circular boss 129 conforming in diameter to the diameter of a flange 130 on the outlet end of the body 118. A thin-walled cylindrical jacket 132 is fitted to the flange 130 and to the flange 114, and forms an air space surrounding the portion of the body 118 containing the blending chamber 120. Near the end portion 122, the body 118 has a threaded side boss 134 serving as a water injection or supply port 136. The port 136 is disposed with its axis normal to the longitudinal axis of the blending chamber 120 and in intersecting relation with the axis of said chamber. The jacket 132 has a hole 138 aligned with the port 136, and one end of a water supply conduit 140 is connected to said port. The end face 142 of the flange 114 is flat, and lies parallel to the end face 144 of the flange 110. Clamped between the flanges 114 and 110 is an orifice plate 146, sandwiched between a pair of gaskets 148. The plate 146 has a flow restricting orifice 150 therein, sized to meter steam at a desired rate of flow into the blending chamber 120.

The blending chamber 120 is designed with an internal diameter to produce a minimum velocity of 150 feet per second at the junction where the steam andn water are mixed. Such minimum velocity at this point results in a uniform homogenized flow of steam with high moisture content. Another benefit of the high velocity through the blender 2 is that it mixes the steam and water with a minimum of noise. The resultant turbulent mixing creates a continuous flow of very minute implosions without forming any slugs of either steam or water. It has been found that a blender 116 having an overall length of about 9 inches for the body 118 and a diameter of about 1.75 inches for the blending chamber 120 functions satisfactorily in these respects, where the center of the water injection port 136 is positioned at a point two-thirds the length of the body 118, or about 6 inches, from the end face 142 of the flange 114.

Water is supplied to the conduit 140 by the positive displacement pump 38. The pump 38 includes pump heads 152 and 154 at its opposite ends and has a drive shaft 156 on which a pulley 158 is mounted. A drain conduit 160 extends downwardly from the pump 38 through a hole in the channel bracket 36. The motor 40 has a shaft 162 with a pulley 164 thereon, the pulleys 158 and 164 being connected by a belt 166. A guard 168 is secured to the upright channel members 32 and 34, by bolts 32*a* and 34*a*, respectively, and substantially encloses the pulleys 158, 164 and the belt 166.

Figure 6:
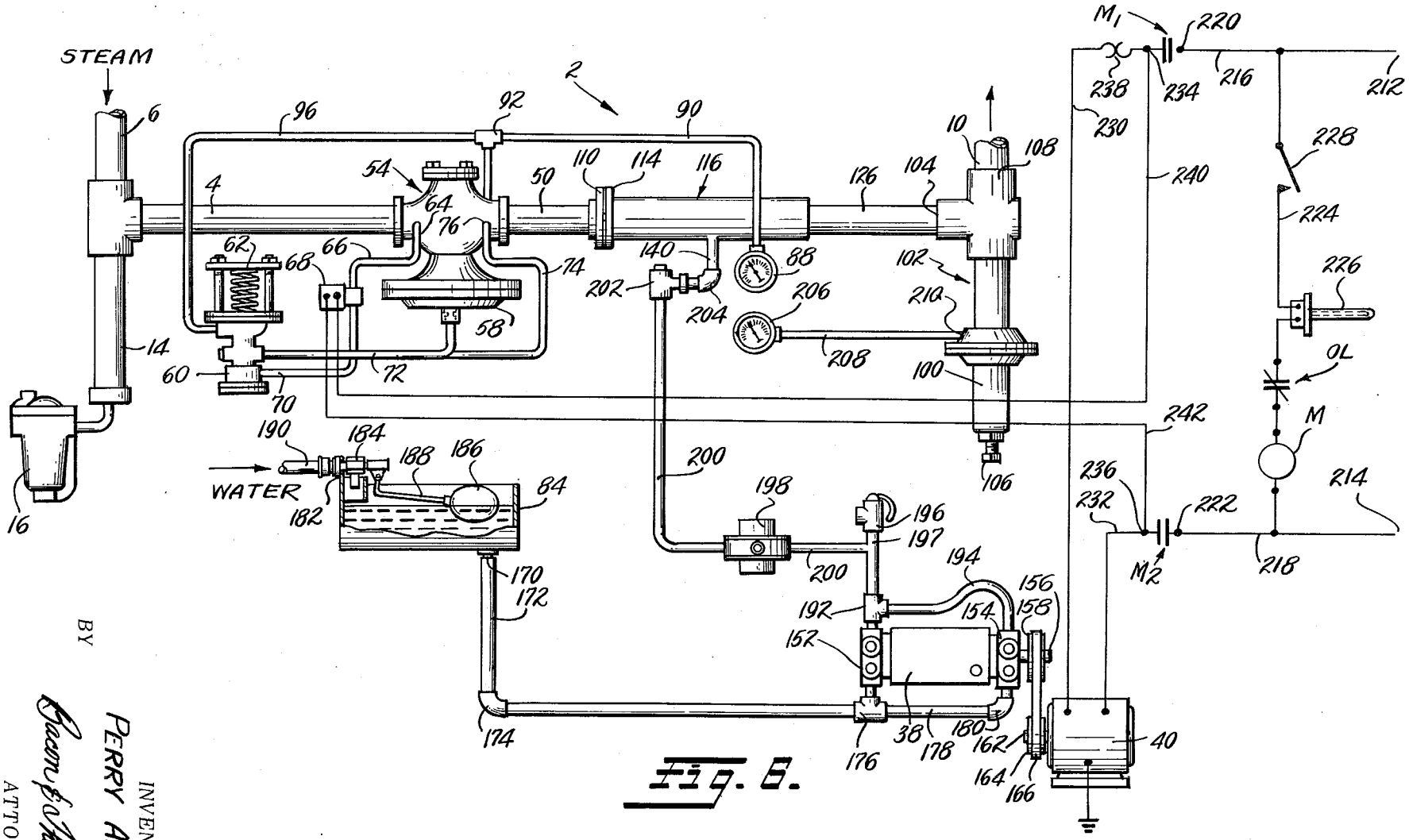
FIG. 6 is a diagrammatic view of the present blending system, including the electrical control elements and the circuit therefor.

Water is supplied to the pump 38 from the supply tank 84, FIG. 6. The tank 84 is elevated above the pump 38, the purpose being to maintain a constant gravity head on the pump to insure pumping of water at a uniform rate. The bottom of the tank 84 has an outlet nipple 170 thereon, to which one end of a suction hose 172 is connected. The other end of the hose 172 is connected to an elbow 174, which elbow is connected to one end of a T-fitting 176 having its center leg connected to the inlet of the pump head 152. The other end of the fitting 176 is connected by a suction hose 178 and an elbow 180 to the inlet of the pump head 154.

Figure 2:
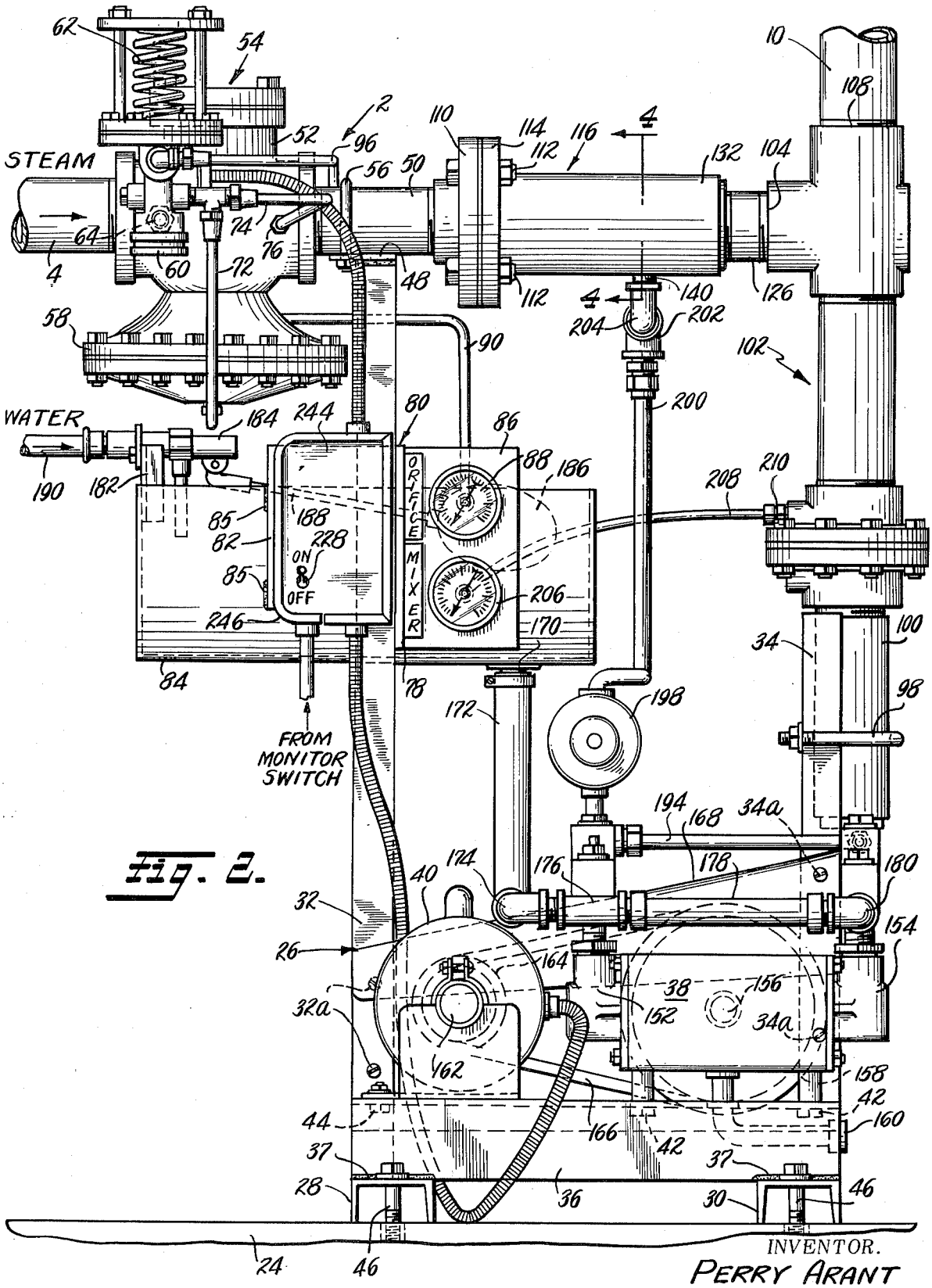
FIG. 2 is an enlarged front elevational view of the steam and water blending assembly of FIG. 1.

Welded to one end of the tank 84, FIG. 2, is a bracket 182, upon which is mounted a valve 184 operated by a float 186 carried on an arm 188. A pipe 190, leading from a supply of water, is connected to the inlet of the float-operated valve 184. The float 186 operates the valve 184 to provide a constant level, about ¾ full, of water in the tank 84, to maintain the constant gravity head on the pump 38.

The outlet of the pump head 152, FIG. 6, is connected to one end of a T-fitting 192, the center leg of said fitting being connected by a pipe 194 to the outlet of the pump head 154. The remaining leg of the fitting 192 is connected to a conventional water pump excess pressure relief valve 196 by a conduit 197, which in turn is connected to the inlet of a conventional back pressure regulator and surge snubber unit 198 by a conduit 200. The conduit 200 connects the outlet of the snubber unit 198 with the inlet of a check valve 202. The outlet of the check valve 202 is connected with the conduit 140 through an elbow 204. The check valve 202 prevents return flow in the conduit 200.

The blending device 2 is preferably designed to produce vapor with a moisture content of about 60% by weight. For proper operation, the steam pressure within the steam main 6 should be about 120 to 140 psi, and the water supply line 190 should be connected to a source of treated water that will deliver about 4¼ to 6 gallons per minute at a minimum pressure of 20 psi. The pressure on the inlet side of the orifice plate 146, that is, within the outlet chamber of the main valve 54, should be about 100 psi. This inlet orifice pressure is transmitted through tube 90 to be measured by the pressure gauge 88, which in FIG. 2 is labeled "ORIFICE."

The pressure within the blending chamber 120 is controlled by the back pressure regulator 102, and should be about 70 psi when the chamber inlet orifice pressure is 100 psi. The blending chamber pressure and the orifice inlet pressure can be set by adjusting the screw 106 on the regulator 102 and the spring 62 on the pilot valve 60, respectively. Because a change in one of said pressures can cause a change in the other, preliminary manipulation and adjustment of both the pilot valve 60 and the regulator 102 is normally required to obtain the desired 100 psi to 70 psi ratio, or a 30 psi differential. The blending chamber pressure is measured by a gauge 206 mounted on the plate 86, and marked "MIXER." The gauge 206 is connected by a tube 208 to a pressure tap 210 on the back-pressure regulator 102. The difference in the readings on the two gauges 88 and 206 represents the pressure differential across the orifice plate 146.

The diameter of the blending chamber metering orifice 150 must be determined for each application and, among other factors, is dependent on the output of the positive displacement pump 38 and the percentage of moisture desired in the wet steam or vapor to be supplied to the treatment vault 12. The operation of the blending device 2 is entirely automatic once it has been adjusted and activated, the main valve 54 and the back pressure regulator 102 functioning automatically to maintain constant the orifice inlet pressure and the blending chamber pressure. The metering orifice 150, as a result of the constant inlet pressure, meters steam at a constant rate of flow into the blending chamber 120, where it is mixed with water supplied at a constant rate of flow by the positive displacement pump 38. The result is a supply of steam to the conduit 10 at a constant pressure and volume, and with a constant moisture content.

The blending device 2 is controlled by a circuit shown schematically in FIG. 6. This circuit includes power terminals 212 and 214 that are connected to a suitable source of 115 volt, 60 cycle current. Leads 216 and 218 extend from the power terminals 212 and 214 to terminals 220 and 222, respectively, on one side of a pair of relay switches $M_1$ and $M_2$ associated with a magnetic controller M. The magnetic controller is connected in a line 224 extending between the leads 216 and 218. The line 224 also contains, in series with the controller M, an overload relay OL, a thermally responsive condensate temperature sensing switch 226, and a master "ON-OFF" switch 228. When the magnetic controller M is energized, the relay switches $M_1$ and $M_2$ are closed, and when the controller M is deenergized said relay switches open.

A pair of conductors 230 and 232 extend from terminals 234 and 236 on the relay switches $M_1$ and $M_2$, respectively, to the motor 40, the line 230 containing an overload switch 238. A second pair of conductors 240 and 242 is also connected to the terminals 234 and 236, respectively, and lead to the solenoid control valve 68. The valve 68 is designed to be closed when deenergized, and thus closes when either of the switches 228 and 226, or the overload relay OL, opens.

The master "ON-OFF" switch 228, FIG. 2, is mounted on the front panel 244 of a control box 246 secured to the bracket leg 78 by bolts 281 and is operable when switched to "OFF" to entirely close down the blending device 2. The sensing switch 226 is designed to be set to a selected condensate temperature, and is positioned so that it is in the path of flow of the condensate in the condensate trough 20 of the vault 12. The sensing switch 226 is designed to remain closed until the condensate temperature rises above the present response temperature, at which time it opens. When the condensate temperature falls below the preset response temperature, the switch 226 will close.

When the master switch 228 is in an "ON", or closed, position, it is seen that the blending device 2 is controlled by the sensing switch 226 in accordance with the condensate temperature. When the vault 12 is cool and the temperature in the condensate trough 20 is below the present response temperature of the switch 226, the solenoid valve 68 will be open and the motor 40 will be energized. The blending device 2 will then function automatically to supply wet steam to the vault 12, causing the temperature within the vault 12 and of the condensate flowing in the trough 20 to rise. When the condensate temperature in the trough 20 rises sufficiently to open the switch 226, the solenoid valve 68 will close and the pump motor 40 will stop, thus closing down the blending device 2 and stopping any further steam flow into the vault 12.

The sensing switch 226 could be positioned elsewhere in the vault 12, or some other sensing device could be substituted therefor. Indeed, it is obvious that many modifications and variations of the present invention are possible for environments where highly saturated steam is desired. It is, therefore, to be understood that the invention can be practiced otherwise than as specifically illustrated and described.

I claim:

1. Steam and water blending apparatus connectable to a source of substantially dry steam and to a supply of water, and operable to blend said dry steam with said water to produce highly saturated steam, comprising a blender containing a blending chamber, said blending chamber having a steam inlet, a water injection port, and an outlet for blended steam and water; means connected with said steam inlet for receiving dry steam from said source and supplying such steam at a metered rate and at a substantially constant pressure to said blending chamber, said means including: a pilot valve controlled pressure reducing valve for receiving the dry steam and reducing its pressure; and an orifice plate connected between said pressure reducing valve and the steam inlet of said blending chamber, said orifice plate having a flow restricting orifice for metering the rate of steam flow into said blending chamber; means connected with said water injection port for receiving water from said supply of water for injecting such water into said blending chamber in metered quantity and at a substantially constant pressure; and means connected with said outlet for maintaining a substantially constant pressure within said blending chamber.

2. Apparatus as recited in claim 1, wherein the pressure reducing valve is such that it reduces the pressure of the steam supplied to the blending chamber to about 100 psig.

3. Apparatus as recited in claim 1, wherein a first pressure gauge is connected to sense pressure upstream of the orifice plate, and a second pressure gauge is connected to sense pressure downstream of said orifice plate, whereby the difference in the readings on said gauges represents the pressure differential across said orifice plate.

4. Apparatus as recited in claim 1, wherein the pressure reducing valve and the means for maintaining a constant back pressure in the blending chamber are such that a pressure differential of about 30 psig is maintained across the orifice plate.

5. Steam and water blending apparatus connectable to a source of substantially dry steam and to a supply of water, and operable to blend said dry steam with said water to produce highly saturated steam, comprising: a blender containing a blending chamber, said blending chamber having a steam inlet, a water injection port, and an outlet for blended steam and water; means connected with said steam inlet for receiving dry steam from said source and supplying such steam at a metered rate and at a substantially constant pressure to said blending chamber, said means including: a pilot valve controlled pressure reducing valve for receiving the dry steam, and an orifice plate connected between said pressure reducing valve and the steam inlet of said blending chamber, said orifice plate having a flow restricting orifice for metering the rate of flow into said blending chamber; means connected with said water injection port for receiving water from said supply of water for injecting such water into said blending chamber in metered quantity and at a substantially constant pressure, said means for supplying water to the water injection port of the blending chamber including: a positive displacement pump, a motor connected to drive said pump, and means arranged to maintain a substantially constant head of water on the pump inlet; and means connected with said outlet for maintaining a substantially constant pressure within said blending chamber, said last-mentioned means including: a back pressure regulator having an inlet to receive the blended steam and water from the blending chamber and having an outlet for supplying the blended steam and water to a point of use.

6. Apparatus as recited in claim 5, wherein a first pressure gauge is connected with the outlet side of the pressure reducing valve and a second pressure gauge is connected with the back pressure regulator, whereby the difference in the readings on said gauges represents the pressure differential across the blender.

7. Apparatus as recited in claim 5, wherein the back pressure regulator is such that it maintains a pressure of about 70 psig in the blending chamber.

8. Apparatus as recited in claim 7, wherein the pressure fluid conduit in which the solenoid valve is mounted is connected with the inlet side of the pressure reducing valve to derive operating pressure fluid therefrom.

9. Apparatus as recited in claim 8, wherein the switch means includes a thermally responsive temperature sensing switch connected in the circuit so as to activate the pump motor and solenoid valve when the temperature to which said sensing switch is exposed is below a pre-set value and to deactivate said pump motor and solenoid valve when the temperature to which said sensing switch is exposed is above a pre-set value.

10. Steam and water blending apparatus connectable to a source of substantially dry steam and to a supply of water, and operable to blend said dry steam and said water to produce highly saturated steam, comprising: a blender containing a blending chamber, said blending chamber having a steam inlet, a water injection port, and an outlet for blended steam and water; means connected with said steam inlet for receiving dry steam from said source and supplying such steam at a metered rate and at a substantially constant pressure to said blending chamber, said means including: a fluid pressure operable pressure reducing valve for receiving the dry steam, a pilot valve connected in a pressure fluid conduit arranged to control said pressure reducing valve, and an orifice plate having a flow restricting orifice for metering the rate of flow of steam into said blending chamber; means connected with said water injection port for receiving water from said supply of water for injecting such water into said blending chamber in metered quantity and at a substantially constant pressure, said means for supplying water to the water injection port of the blending chamber including: a positive displacement pump, a motor connected to drive said pump, and means arranged to maintain a substantially constant head of water on the pump inlet; and means connected with said outlet for maintaining a substantially constant pressure within said blending chamber.

11. Apparatus as recited in claim 10, including additionally: a solenoid valve connected in the pressure fluid conduit on the inlet side of the pilot valve; and a control circuit connected with said solenoid valve and with said pump motor, said circuit including switch means for simultaneously activating and deactivating said motor and said solenoid valve.

* * * * *

UNITED STATES PATENT AND TRADEMARK OFFICE

CERTIFICATE OF CORRECTION

PATENT NO. : 3,987,130

DATED : Oct. 19, 1976

INVENTOR(S) : Perry Arant

It is certified that error appears in the above-identified patent and that said Letters Patent are hereby corrected as shown below:

Column 6, line 17, change "andn" to -- and --.

Column 8, line 26, change "present" to -- preset --.

Column 8, line 34, change "present" to -- preset --.

Signed and Sealed this

Twenty-second Day of February 1977

[SEAL]

*Attest:*

RUTH C. MASON
*Attesting Officer*

C. MARSHALL DANN
*Commissioner of Patents and Trademarks*